US009680249B2

(12) United States Patent
Dvorak et al.

(10) Patent No.: US 9,680,249 B2
(45) Date of Patent: Jun. 13, 2017

(54) MOLDED ENCLOSURES HAVING A SEAMLESS APPEARANCE

(71) Applicant: Apple Inc., Cupertino, CA (US)

(72) Inventors: Peter A. Dvorak, Menlo Park, CA (US); Siri Amrit Ramos, San Francisco, CA (US); Xuyang Zhang, San Jose, CA (US); Cesar Lozano Villarreal, Sunnyvale, CA (US); Ciaran J. Keane, San Carlos, CA (US); Alexander M. Kwan, Los Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/282,768

(22) Filed: Sep. 30, 2016

(65) Prior Publication Data

US 2017/0093078 A1 Mar. 30, 2017

Related U.S. Application Data

(60) Provisional application No. 62/235,409, filed on Sep. 30, 2015.

(51) Int. Cl.

| | |
|---|---|
| ***H01R 43/24*** | (2006.01) |
| ***H01R 31/06*** | (2006.01) |
| ***H01R 13/516*** | (2006.01) |
| ***H01B 17/64*** | (2006.01) |
| ***H01R 13/504*** | (2006.01) |
| ***H01R 43/18*** | (2006.01) |
| ***H01R 13/66*** | (2006.01) |

(52) U.S. Cl.
CPC ..... *H01R 13/504* (2013.01); *H01R 13/665* (2013.01); *H01R 31/065* (2013.01); *H01R 43/18* (2013.01)

(58) Field of Classification Search
CPC ..... H01R 43/24; H01R 31/06; H01R 13/516; H01R 13/405; H01R 13/5845; H01R 23/025; H01R 13/64; H01R 13/506; H01R 13/658; H01B 17/145; H01B 17/64
USPC ..... 439/604, 606, 106, 638, 901–906; 320/111; 174/98; 363/146, 142, 143
See application file for complete search history.

(56) References Cited

U.S. PATENT DOCUMENTS

| | | | | |
|---|---|---|---|---|
| 4,737,124 A * | 4/1988 | Ezure | H01R 23/26 | 439/585 |
| 5,647,751 A * | 7/1997 | Shulman | H01R 13/639 | 439/106 |
| 6,932,640 B1 * | 8/2005 | Sung | H01R 4/2433 | 439/405 |
| 7,048,563 B2 * | 5/2006 | Fukuda | H01R 13/5216 | 439/274 |
| 7,922,540 B2 * | 4/2011 | Zhang | H01R 13/68 | 439/106 |
| 8,753,132 B2 * | 6/2014 | Scritzky | H01R 24/30 | 439/106 |
| 9,343,850 B2 * | 5/2016 | Colahan | | |

(Continued)

*Primary Examiner* — Gary Paumen
(74) *Attorney, Agent, or Firm* — Kilpatrick Townsend and Stockton, LLP

(57) ABSTRACT

An enclosure for an AC to DC adapter has a continuous and seamless exterior surface. The enclosure includes a housing and a front wall that are joined by a bonded interface. The front wall is formed from a metallic interface plate and an exterior layer of plastic that is formed over the metallic interface plate and bonded to the housing.

20 Claims, 10 Drawing Sheets

(56) References Cited

U.S. PATENT DOCUMENTS

| | | | | |
|---|---|---|---|---|
| 2005/0054239 | A1* | 3/2005 | Su | H01R 43/24 439/606 |
| 2007/0293087 | A1* | 12/2007 | Kennedy | H01R 13/405 439/606 |
| 2009/0059636 | A1* | 3/2009 | Ho | H02J 7/34 363/146 |
| 2014/0308853 | A1* | 10/2014 | Colahan | H01R 13/6675 439/628 |
| 2015/0255915 | A1* | 9/2015 | Kao | H01R 24/28 439/606 |

* cited by examiner

MOLDED ENCLOSURES HAVING A SEAMLESS APPEARANCE

CROSS-REFERENCES TO OTHER APPLICATIONS

This application claims priority to U.S. provisional patent application Ser. No. 62/235,409, for "SEAMLESS ELECTRONIC ENCLOSURE" filed on Sep. 30, 2015 which is hereby incorporated by reference in entirety for all purposes.

FIELD

The described embodiments relate generally to enclosures that have the appearance of being seamless. More particularly, the present embodiments relate to plastic enclosures that appear seamless and house one or more electronics assemblies.

BACKGROUND

Currently there are a wide variety of electronic devices that have enclosures to facilitate the use of the electronic device and provide an aesthetic appearance. However, often such enclosures have one or more seams where plastic components of the enclosure meet. The seams can disrupt the exterior surface of the enclosure impairing its aesthetics and sometimes creating a relatively weak region of the enclosure that is prone to damage and breakage. This can be particularly problematic for enclosures that contain high-voltage electronic components that would be exposed if such a seam were to be broken. New enclosures are needed for electronic assemblies that are seamless, or at least have the appearance of being seamless, and/or that have improved structural integrity.

SUMMARY

Some embodiments of the present disclosure relate to enclosures having a seamless look and feel that are used to encase an electronic assembly. Some embodiments relate to an enclosure that can be used for any electronic device while other embodiments relate to an enclosure for an AC to DC adapter.

In some embodiments an enclosure for an electronic assembly has a seamless exterior appearance and comprises a housing having a rear wall and at least one side wall extending from the rear wall to a distal end. A front wall includes a front wall support and an exterior layer formed over the front wall support, wherein the front wall, the rear wall, and the at least one side wall define a cavity in which the electronic assembly is disposed. At least two electrical prongs are disposed through the rear wall and are electrically coupled to the electronic assembly positioned within the cavity. A receiving opening extends through the front wall and is in communication with the cavity.

In various embodiments the front wall support is planar. In some embodiments the front wall support has a convex shape. In various embodiments the front wall support is formed from a metal and the exterior layer is formed from a plastic. In some embodiments a ledge is formed in the at least one side wall.

In some embodiments the front wall support has a first side disposed against the ledge and a second side disposed against the exterior layer. In various embodiments the electrical assembly has a connector aligned with the receiving opening. In some embodiments the electronic assembly is an AC to DC adapter that receives AC power through the at least two electrical prongs and supplies DC power out of the connector. In various embodiments a trim ring is fit within the receiving opening. In some embodiments an interface between the exterior layer of the front wall and the at least one side wall is curved.

In some embodiments a method of forming an enclosure having a seamless exterior comprises forming a housing having a rear wall opposite an opening and at least one sidewall extending between the rear wall and the opening forming a cavity, wherein the rear wall is formed around at least two electrical prongs extending through the rear wall. An electronic assembly is placed within the cavity such that it is electrically coupled to the at least two electrical prongs. A front wall support having an aperture is placed within the opening. An exterior layer is formed on an outside surface of the front wall support such that an exterior surface of the enclosure has a seamless appearance and has a receiving opening aligned with the aperture.

In various embodiments a ledge is formed in a distal end of the at least on sidewall and the front wall support is placed on the ledge. In some embodiments the exterior layer is formed with an injection molding process. In various embodiments the exterior layer bonds to the at least one sidewall at an interface. In some embodiments the front wall support is held in place during the forming of the exterior layer with tooling having a pair of fingers that extend through the aperture.

In some embodiments the pair of fingers form a receiving opening in the exterior layer. In various embodiments the receiving opening is aligned with the aperture and a trim ring is placed within the receiving opening. In some embodiments injection mold tooling applies a force against the front wall support towards the rear wall such that plastic is prevented from flowing into the cavity during formation of the exterior layer. In various embodiments the housing has first sidewall opposite a second sidewall and a third sidewall opposite a fourth sidewall. In some embodiments the housing has one sidewall forming a cylinder.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

DETAILED DESCRIPTION

Some embodiments of the present disclosure relate to electronic devices that have a plastic enclosure that has the appearance and feel of not including any seams (e.g., having an apparently seamless enclosure). Various embodiments relate to enclosures that can also have improved structural integrity at the enclosure edges and/or resiliency to water or dust penetration. While the present disclosure can be useful for a wide variety of configurations, some embodiments of the disclosure are particularly useful for high voltage electronic assemblies encased in plastic enclosures, as described in more detail below.

For example, in some embodiments an injection molded plastic housing is formed with a cavity in communication with an opening, and a pair of AC wall adapter prongs that extend out of a face of the housing. An AC to DC converter assembly that includes high voltage circuitry is installed within the cavity and coupled to the prongs. A front wall support is placed in the opening and an exterior plastic layer is formed over the front wall support forming a visually continuous exterior surface at seams where the exterior plastic layer meets the housing. The exterior plastic layer has a receiving opening through which a DC connector can be coupled to the AC to DC converter.

In order to better appreciate the features and aspects of housings having a seamless appearance according to the present disclosure, further context for the disclosure is provided in the following section by discussing two particular implementations of electronic devices according to embodiments of the present disclosure. These embodiments are for example only and other embodiments can be employed in other electronic devices such as, but not limited to computers, watches, media players, RFID tags and other devices.

Figure 1:
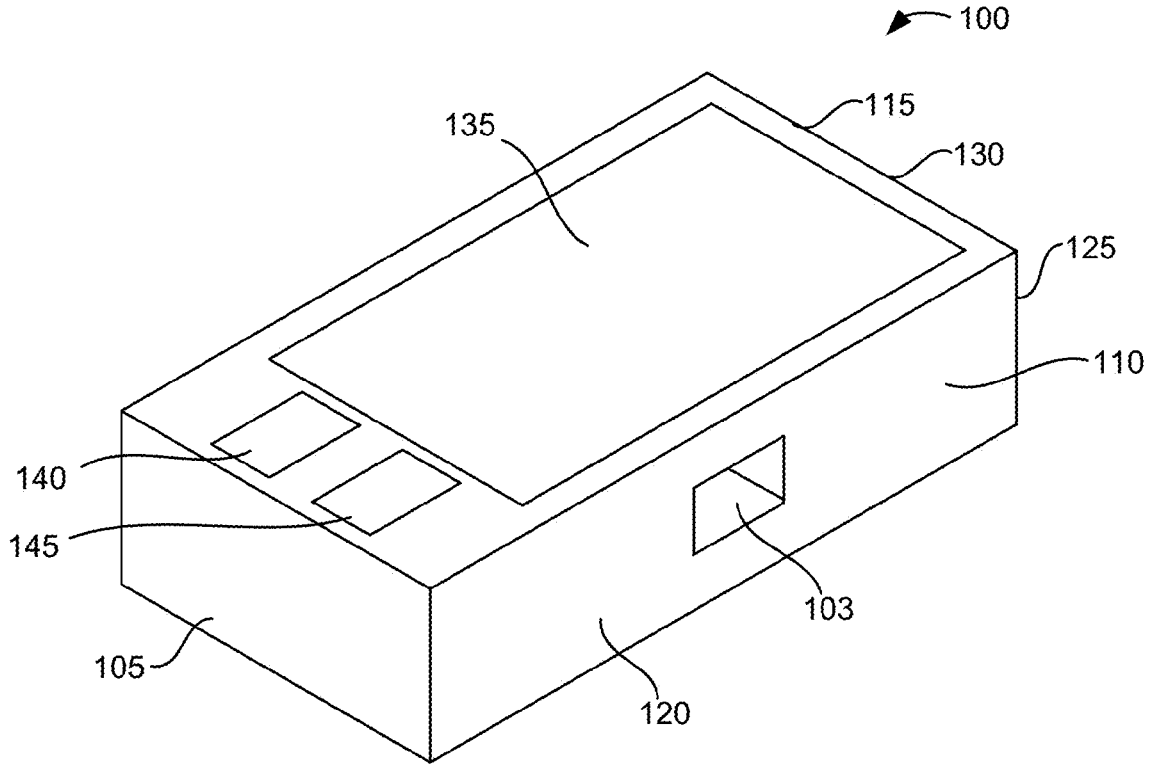
FIG. 1 is a front perspective view of an electronic device having a visually continuous exterior surface according to an embodiment of the disclosure.

FIG. 1 illustrates a simplified perspective view of an electronic device 100 according to some embodiments of the disclosure. As shown in FIG. 1, electronic device 100 has an enclosure 105 with an aperture 103 and a visually continuous exterior surface 110 having the appearance and feel of being seamless. More specifically, enclosure 105 includes a housing 115 and a front wall 120 that are visually continuous at a seam 125 where the housing and front wall meet. The seamless appearance can be aesthetically pleasing, and can also provide resilience to dust and liquid penetration when aperture 103 is sealed, as described in more detail below. Further, seam 125 can be imperceptible to a user's touch giving electronic device 100 a smooth monolithic feel. In some embodiments seam 125 can be formed to have sufficient mechanical strength so that front wall 120 cannot be easily separated from housing 115 and edges 130 of enclosure 105 resist fracturing.

In the embodiment shown in FIG. 1, enclosure 105 is illustrated as including a display 135 (e.g., a touch display), an aperture 103 and first and second input buttons 140, 145. In some embodiments an electronic connector is disposed within aperture 103 and can receive a mating connector that can charge electronic device 100 and/or be used to communicate data to and from the electronic device. Embodiments of the disclosure are not limited to any particular electronic device, however, and in other embodiments enclosure 105 can be used for devices that have different components than what is shown in FIG. 1. The seamless appearance of enclosure 105 can be both aesthetically pleasing and useful to make enclosure 105 liquid-tight. In one example, a liquid tight receptacle connector is disposed within aperture 103 such that enclosure 105 is liquid tight.

In various embodiments enclosure 105 can be used to enclose other electronics assemblies such as, but not limited to a wireless communication transceiver, a wireless router, an RFID device or an AC to DC adapter, as explained in more detail below. In some particular embodiments enclosure 105 can be part of a device that includes wireless transceiver, and a rechargeable battery. In further embodiments, enclosure 105 can be used for purposes other than enclosing an electronic device. In one example, enclosure 105 can be used to enclose an antique (e.g., a coin or a piece of ancient artwork) that needs to protected from damage and have an aesthetically appealing appearance.

As defined herein, liquid-tight shall mean a seal that conforms to one or more of the following ratings as defined by the International Protection Rating and International Electrochemical Commission (IEC) 60529 that can also be known as the I.P. 68 rating. In some embodiments the liquid-tight seal will protect the electronic assembly against the harmful ingress of water and have a "liquid ingress" rating between 1 (dripping water) and 8 (immersion beyond 1 meter). In various embodiments the liquid-tight seal shall be rated between 1 (dripping water) and 4 (splashing water) while in some embodiments the liquid-tight seal shall be rated between 2 (dripping water with device tilted at 15 degrees) and 5 (water jet). In various embodiments the liquid-tight seal shall be rated between 3 (spraying water) and 6 (powerful water jets) while in some embodiments the liquid-tight seal shall be rated between 4 (splashing water) and 7 (immersion up to 1 meter). In various embodiments the liquid-tight seal shall be rated between 5 (water jets) and 8 (immersion beyond 1 meter) while in some embodiments liquid-tight shall mean the seal will protect the electronic device against liquid ingress up to 100 feet for 30

Figure 2:
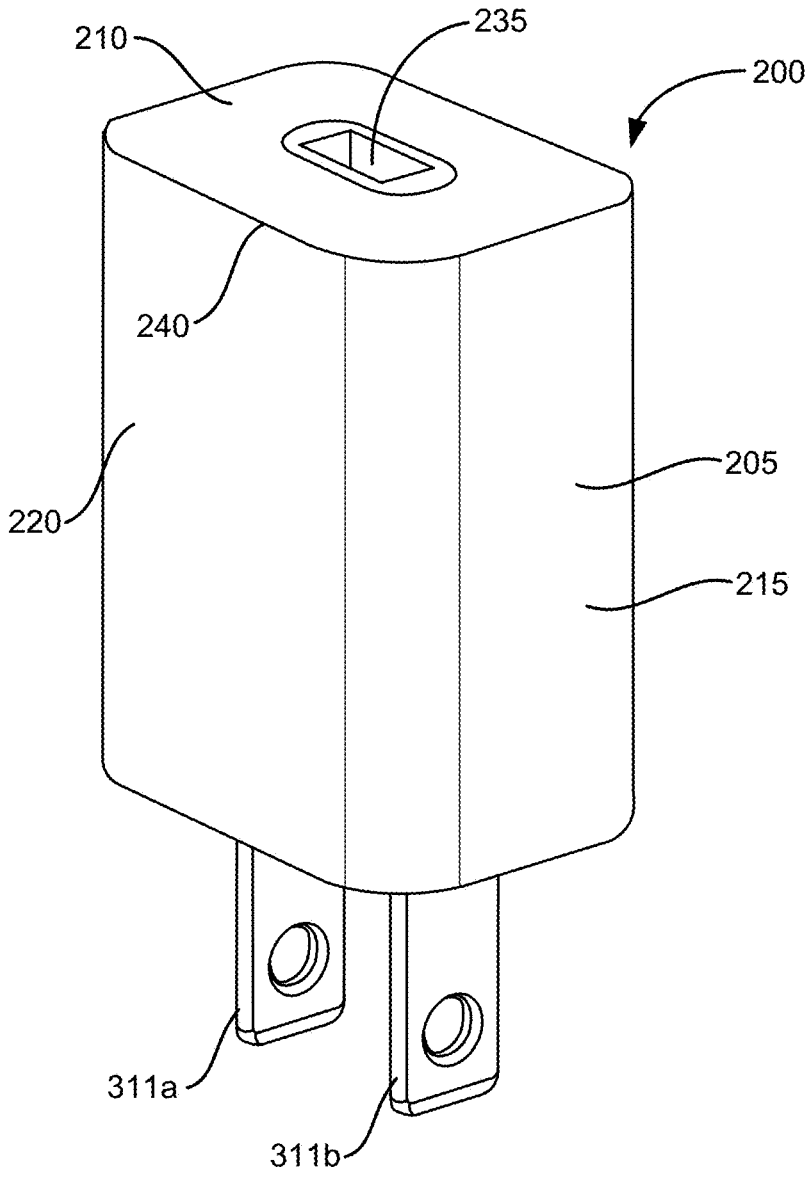
FIG. 2 is a front perspective view of an AC to DC adapter having a visually continuous exterior surface according to an embodiment of the disclosure.

Now referring to FIG. 2 a simplified perspective view of an electronic device 200 having a seamless appearance is illustrated. As shown in FIG. 2, electronic device 200 can be an AC to DC adapter that includes an enclosure 205 having a visually continuous exterior surface 220. In this embodiment, enclosure 205 encases an AC to DC electronics assembly (not shown in FIG. 1), as discussed in more detail below.

Electronic device 200 has a pair of electrical prongs 311*a*, 311*b* that are configured to be plugged into an AC wall outlet to receive AC power. A receiving opening 235 is configured to receive a connector that can couple DC energy to a separate electronic device. In some embodiments continuous exterior surface 220 can provide device 200 with a pleasing feel for a user since housing 215 is not distinguishable from front wall 210 by touch. In further embodiments seams 240 formed between front wall 210 and housing 215, can be configured to provide improved structural integrity such that enclosure 205 is able to withstand high mechanical forces.

In this particular embodiment enclosure 205 is for an AC to DC adapter where electrical prongs 311*a*, 311*b* are configured to be plugged into a wall outlet and receiving opening 235 is configured to receive a connector that can couple DC energy to an electronic device. However, other embodiments can have electronic assemblies with different functions than an AC to DC adapter.

Figure 3:
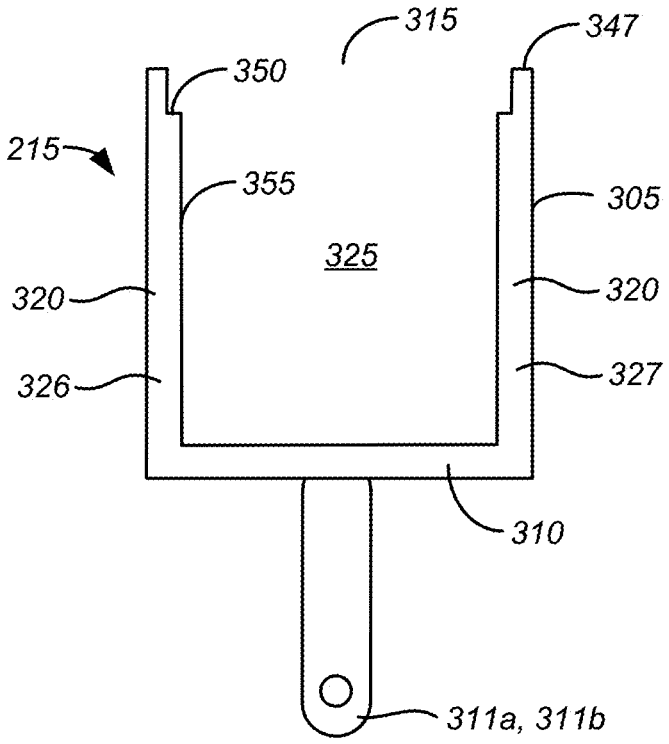
FIG. 3 is a cross-sectional view of a housing for the AC to DC adapter illustrated in FIG. 2.

FIGS. 3-7 illustrate sequential steps of forming electronic device 200. FIG. 3 illustrates a cross-sectional view of housing 215. Housing 215 can have a seamless, or apparently seamless, exterior surface 305 and can be made out of a single piece of material. Housing 215 can have a rear wall 310 opposite an opening 315 and at least one sidewall 320 extending between the rear wall and the opening, forming a cavity 325. In the example illustrated in FIG. 3 there can be four sidewalls while a cylindrically shaped enclosure housing can have a single wall that encircles the electronic assembly. More specifically, in some embodiments housing 215 can have a first sidewall 326 opposite a second sidewall 327 and a third sidewall opposite a fourth sidewall (not shown in FIG. 3).

The at least one sidewall 320 has a distal end 347 with a ledge 350 formed therein. More specifically, ledge 350 can be formed in an interior surface 355 the of at least one sidewall 320 around a perimeter of opening 315.

Rear wall 310 can be formed around at least two electrical prongs 311*a*, 311*b* that are disposed through the rear wall (the second prong is disposed directly behind the prong illustrated in FIG. 3). In other embodiments the at least two electrical prongs 311*a*, 311*b* can be inserted after the formation of housing 215. Rear wall 310 and the at least one side wall 320 can be formed of plastic, such as a polycarbonate, and can be fabricated with an injection molding machine. In one embodiment the polycarbonate material can be unfilled, while in other embodiments it can have between 1 percent and 20 percent glass fiber or other reinforcement. In another embodiment the polycarbonate material can be RA46, LCP, nylon, PC-PBT or any other type of polycarbonate material.

Figure 4:
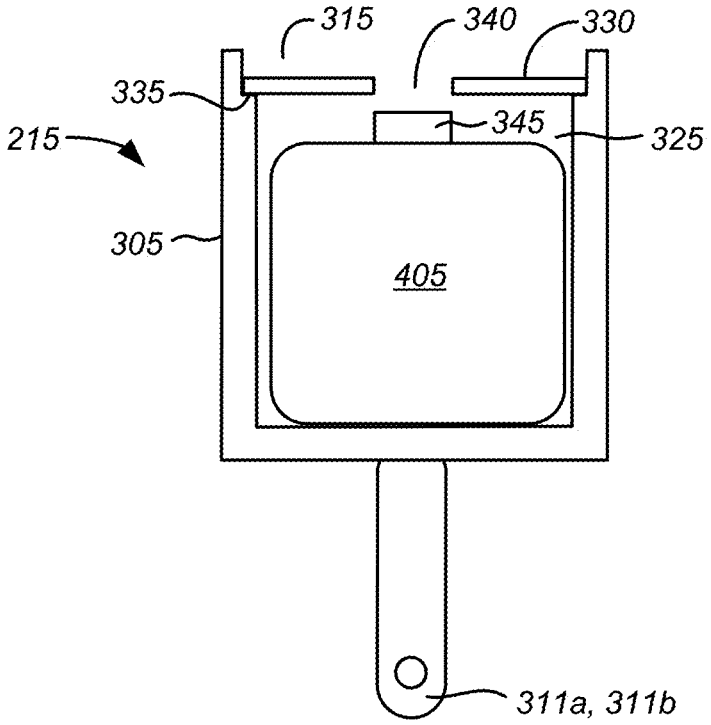
FIG. 4 is a cross-sectional view of a housing including a front wall support and an electronic assembly for the AC to DC adapter illustrated in FIG. 2.

FIG. 4 illustrates a cross-sectional view of housing 215 with a front wall support 330. As shown in FIG. 4, an electronic assembly 405 including AC to DC power conversion circuitry has been inserted within cavity 325 and electrically coupled to at least two electrical prongs 311*a*, 311*b*. In addition, a front wall support 330 has been placed within opening 315 of housing 215 and is supported by ledge 335. Front wall support 330 has an aperture 340 aligned with a receptacle connector 345 that extends out of electronics assembly 405. In some embodiments receptacle connector 345 can be a USB or other type of electrical connector, such as, but not limited to a USB-C connector.

Figure 5:
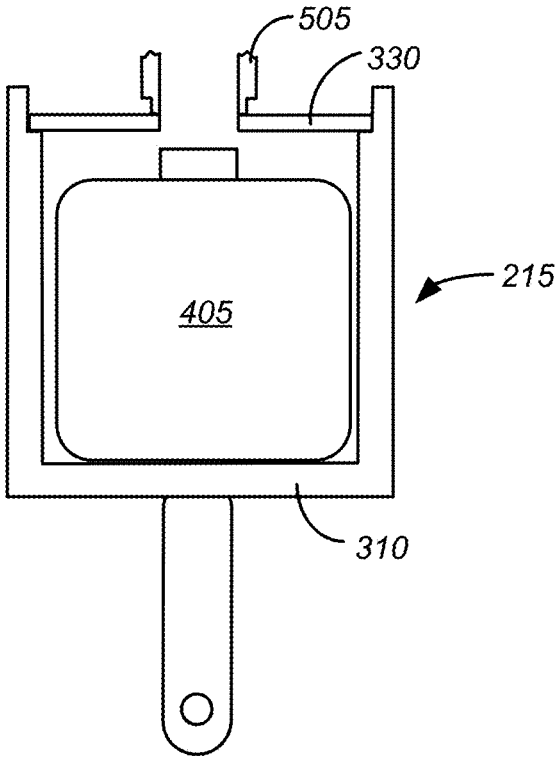
FIG. 5 is a cross-sectional view of injection mold tooling against the front wall support illustrated in FIG. 4.

FIG. 5 illustrates a simplified cross-sectional view of housing 215 positioned within injection molding tooling 505 that forms exterior layer 605. As shown in FIG. 5, a portion of an injection mold tool 505 is in contact with front wall support 330. Only the portion of injection mold tool 505 that is in contact with front wall support 330 is shown and other portions of the injection mold tooling have been hidden for clarity. Injection mold tool 505 pushes against front wall support 330, towards rear wall 310 of housing 215, forming a seal between the injection mold tooling and the front wall support. Front wall support 330 is pushed against housing 215 forming a seal between the front wall and the housing.

Figure 6:
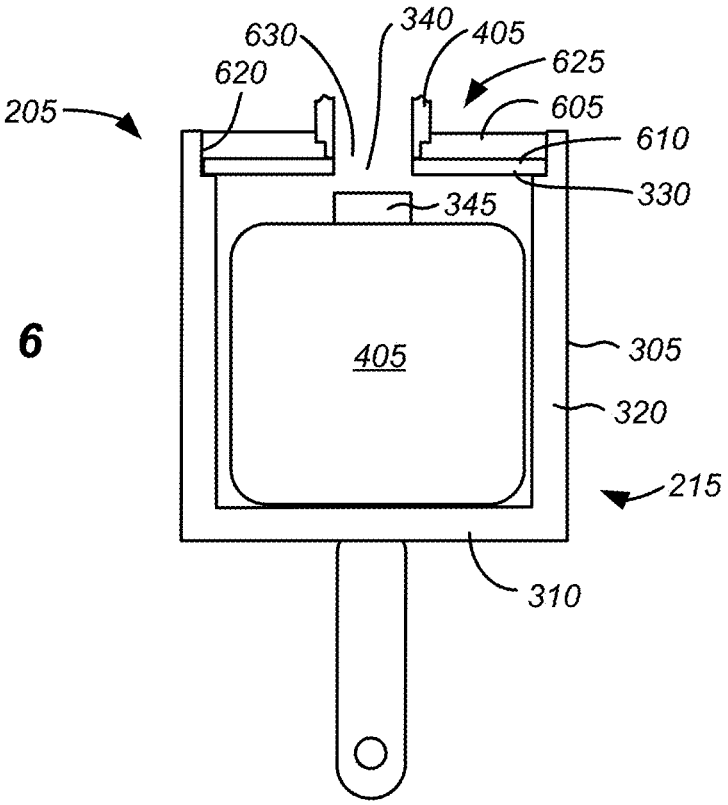
FIG. 6 is a cross-sectional view of an exterior layer that has been formed against the front wall support illustrated in FIG. 4.

FIG. 6 illustrates a simplified cross-sectional view of housing 215 with an exterior layer 605 formed on front wall support 330. As shown in FIG. 6, an exterior layer 605 is formed on an outside surface 610 of front wall support 330 such that exterior surface 305 of enclosure 205 has a seamless exterior appearance. More specifically, in some embodiments exterior layer 605 is formed by injecting molten plastic that forms an interface 620 between exterior layer 605 and at least one sidewall 320. In various embodiments exterior layer 605 of plastic cold welds to the at least one sidewall, forming a structural joint as well as a joint with no gap giving enclosure 205 the appearance of being seamless. In some embodiments the same plastic material used for exterior layer 605 can be used for at least one sidewall 320. The combination of front wall support 330 and exterior layer 605 make a front wall 625 of completed enclosure 205. Injection mold tool 505 can be configured to preclude molten plastic from flowing into aperture 340 of front wall support 330, forming an opening 630 within front wall 625 of enclosure 205 that is aligned with receptacle connector 345 extending out of electronic assembly 405.

Figure 7:
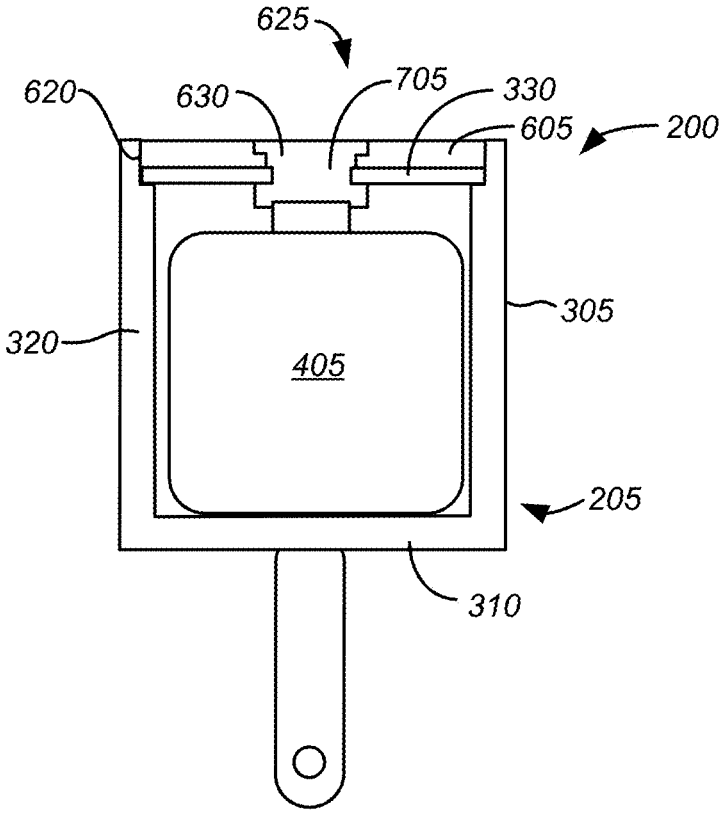
FIG. 7 is a cross-sectional view of the AC to DC adapter illustrated in FIG. 6 with a trim ring.

FIG. 7 illustrates a simplified cross-sectional view of a fully assembled electronic device 200. As shown in FIG. 7, the injection molding tool 505 (see FIG. 6) has been removed and a trim ring 705 is disposed within opening 630 (see FIG. 6). The result is an enclosure 205 surrounding electronic assembly 405 where exterior surface 305 of the enclosure is seamless, or at least has the appearance of being seamless. In addition, enclosure 205 can have improved structural integrity as the cold weld that forms between exterior layer 605 and one or more sidewalls 320 is cold welded along the entire interface 620. Further, front wall support 330 can be made from a metal such as stainless steel, and can provide a significant amount of reinforcement to front wall 625, and to at least one side wall 320 such that when enclosure 205 is compressed it will resist deflection and the cold weld at interface 620 will remain intact.

In some embodiments, such as for example, the AC to DC converter application, improved structural integrity can be beneficial so that the user is not exposed to high voltages. More specifically, by locating interface 620 of the two components between front wall 625 and at least one sidewall 320, if the interface breaks it will expose the less dangerous low voltage portion of electronic assembly 405 instead of the high voltage portion that is near rear wall 310. Further, the increased structural integrity can keep front wall 625 from breaking away from at least one sidewall 320 such that enclosure 205 is safe even when subjected to high impacts or forces.

Figure 8:
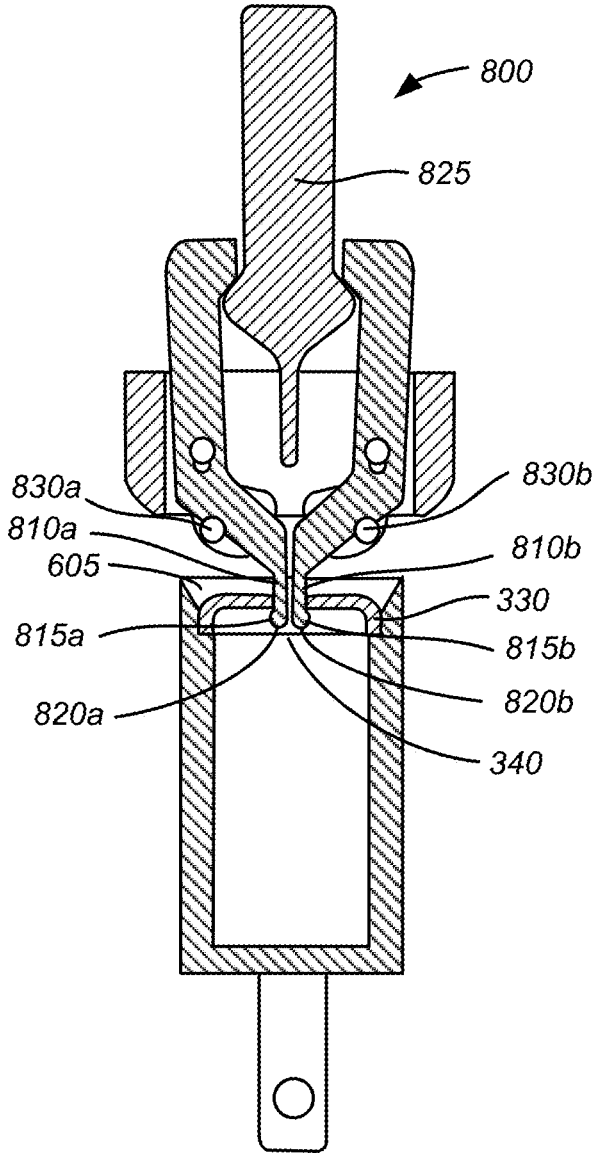
FIG. 8 is a cross-sectional view of an injection molding tool inserted through an aperture in a front wall support plate of an AC to DC adapter according to an embodiment of the disclosure.
Figure 9:
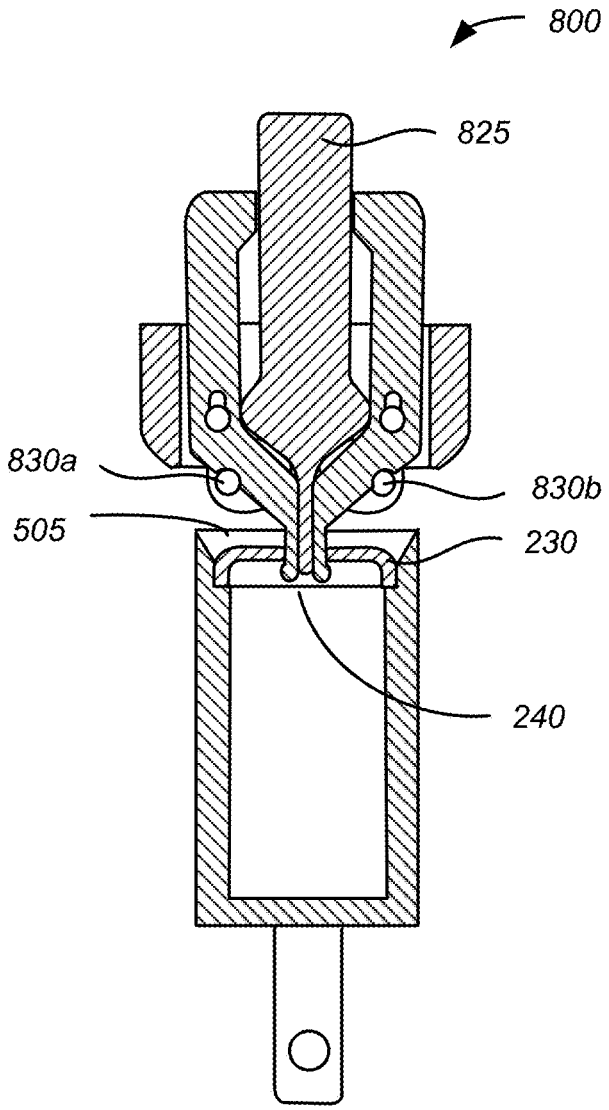
FIG. 9 is a cross-sectional view of an injection molding tool inserted through an aperture in a front wall support plate of an AC to DC adapter according to an embodiment of the disclosure.
Figure 10:
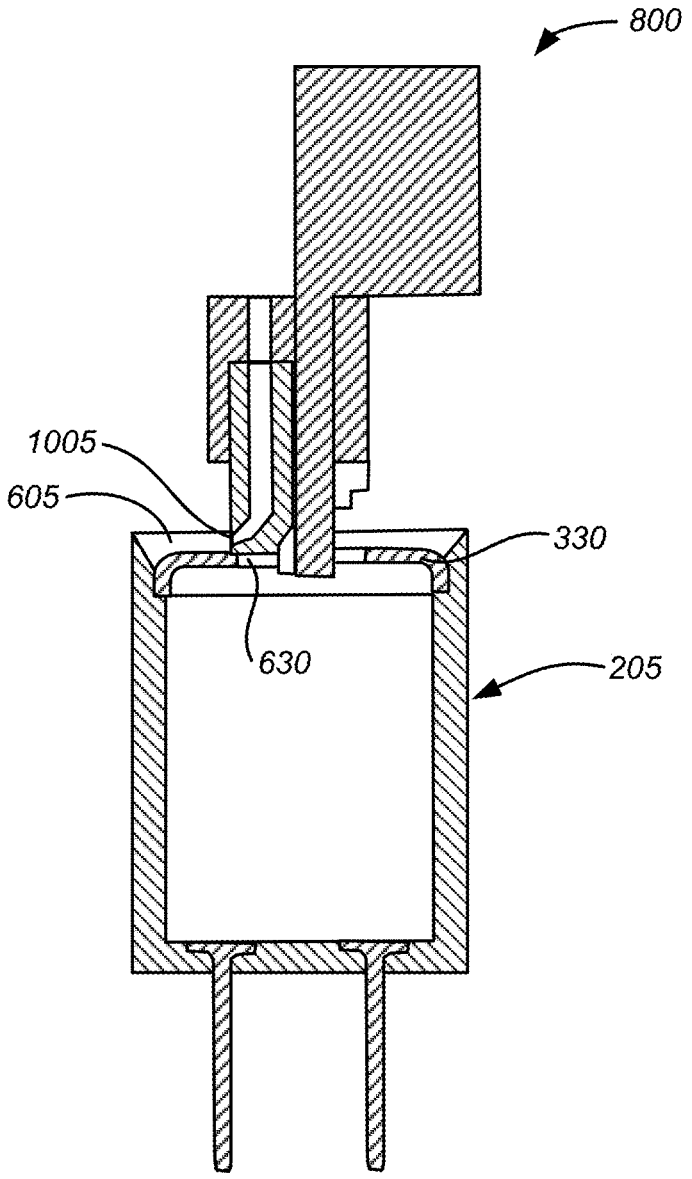
FIG. 10 is a cross-sectional side view of the injection molding tool illustrated in FIGS. 8 and 9.

FIGS. 8-10 illustrate cross-sectional views of another embodiment of an injection mold tool that can be used to form exterior layer 605. As shown in FIG. 8, some embodiments can use an injection mold tool 800 that holds front wall support 330 from deforming during the formation of exterior layer 605, as explained in more detail below. Injection mold tool 800 can have a pair of fingers 810*a*, 810*b* that are inserted through aperture 340 (see FIG. 3) within front wall support 330. Each finger 810*a*, 810*b* has a catch 815*a*, 815*b*, that can be an enlarged area, formed on a distal end 820*a*, 820*b* such that when the fingers are forced apart, as illustrated in FIG. 9, the catch will not let the fingers pull out of aperture 340. Thus, in FIG. 9 when fingers 810*a*, 810*b* have been forced apart by a plunger 825, the fingers can pull upwards on front wall support 330 and pull the front wall securely against the tooling 505 (see FIG. 6) such that no molten plastic can leak past the tooling and into aperture 340.

In some embodiments this portion of the injection mold tool can operate similar to a pull or a slide where fingers 810*a*, 810*b* are inserted into aperture 340 when the tool closes and the fingers are forced apart and upward after the tool closes. In further embodiments the action can operate with a pneumatic cylinder, an electronic solenoid or actuator. As shown in FIGS. 8 and 9, two cams 830*a*, 830*b* can be rotated and used to force fingers 810*a*, 810*b* in an upward direction. This tooling can keep front wall support 330 from deforming inward towards rear wall 310 or moving during the injection molding process.

FIG. 10 illustrates a side view a cross-section of the injection mold tooling shown in FIGS. 8 and 9. As shown in FIG. 10, plastic injection gate 1005 can be configured to inject plastic for forming exterior layer 605 into an inside edge of opening 630. In this way the subsequently installed trim ring 705 (see FIG. 7) can cover the gate vestige mark providing an enclosure 205 with a substantially continuous surface.

Figure 11:
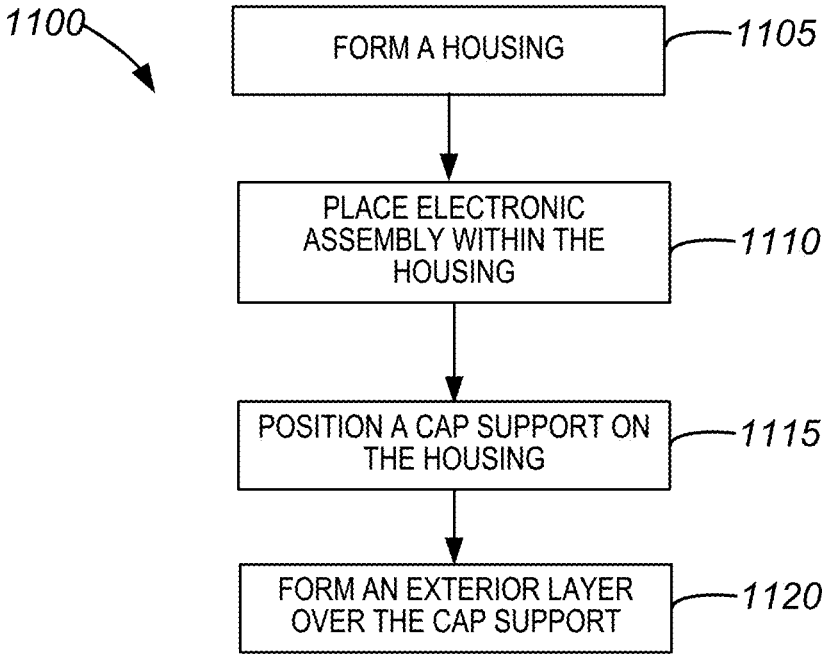
FIG. 11 is a method of forming an AC to DC adapter having an enclosure according to an embodiment of the disclosure.

FIG. 11 illustrates a method of forming an AC to DC adapter having a seamless enclosure. In step 1105 a housing is formed. In some embodiments the housing has a bottom wall and at least one side wall extending from the bottom wall. The at least one side wall includes a distal end having a ledge formed therein. The bottom wall is formed around at least two electrical prongs extending through the bottom wall.

In step 1110 an electronics assembly is placed within the housing. The electronics assembly is electrically coupled to the at least two electrical prongs. In step 1115 a front wall support is positioned on the ledge formed in the at least one sidewall. In step 1120 an exterior layer is formed on the front wall such that a front wall is formed that defines a cavity in which the electronic assembly is disposed. In some embodiments the exterior layer is formed by injection molding.

In some embodiments an automated injection molding and assembly machine can be used to form enclosure 205, insert electronic assembly 405 and form front wall 625 in sequential operations. In some embodiments the automated machine can be a turret type machine where the assembly rotates to different stations while in other embodiments the machines can have a different configuration such as, for example a progressive in-line system.

In some embodiments in a first station housing 215 can be injection molded around two or more electrical prongs 311*a*, 311*b*. Housing 215 can then be moved to a second station where electronic assembly 405 is inserted within housing 215 and is coupled to two electrical prongs 311*a*, 311*b*. In a third station front wall support 330 can be disposed within opening 315 of housing 215. In a fourth station exterior layer 605 can be formed on outside surface 610 of front wall support 330. In a fifth station the assembly can be electrically tested. In some embodiments, by leaving housing 215 in the same tooling it was formed in, tolerance stack ups can become less complex and easier to maintain since there are fewer variables that factor into the tolerance calculations.

Figure 12:
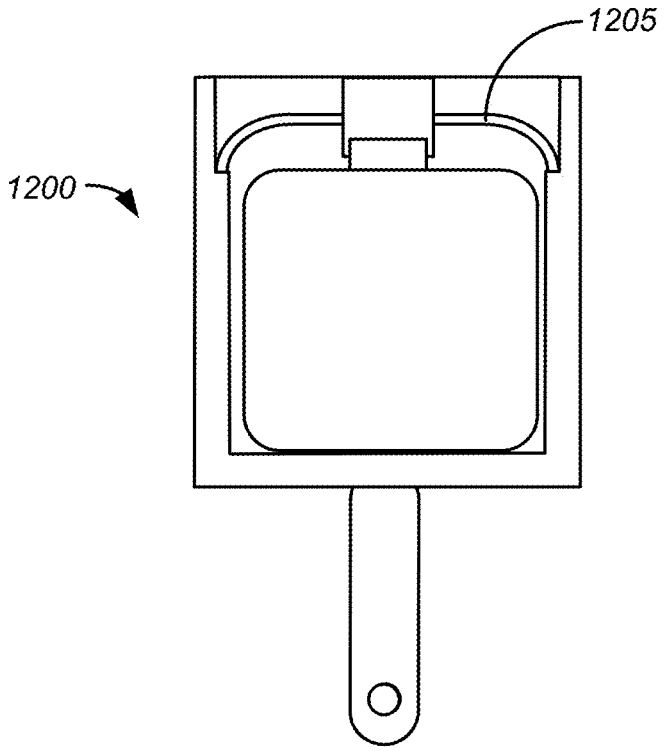
FIG. 12 is a cross-sectional view of a housing for an AC to DC adapter having a convex shaped front wall support according to an embodiment of the disclosure.

FIG. 12 illustrates a cross-section of an AC to DC adapter 1200 that uses a curved front wall support 1205. As illustrated in FIG. 12 some embodiments can incorporate a front wall support 1205 that is curved in one or more dimensions. In this illustration front wall support 1205 is curved on all sides such that it substantially a convex or cup shape. This shape can provide increased strength of front wall 1202 to resist deformation from the injection molding process. Other front wall shapes can be used and other means of reinforcing the front wall can be used and are within the scope of this disclosure. In some embodiments the front wall can be made from stainless steel material.

Figure 13:
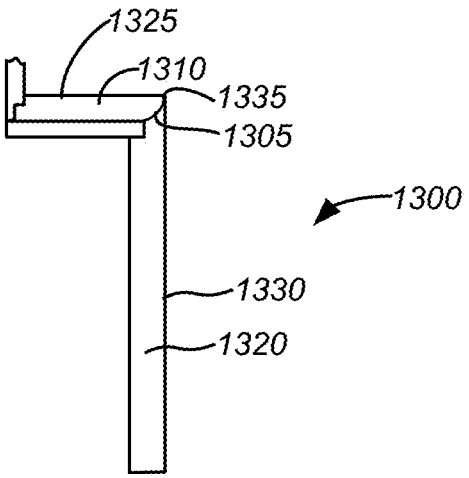
FIG. 13 is a partial cross-sectional view of a curved interface between an exterior layer and at least one sidewall of an enclosure according to an embodiment of the disclosure.

FIG. 13 illustrates a partial cross-sectional view of an enclosure 1300. As shown in FIG. 13 some embodiments can use curved or angular interface 1305 between exterior layer 1310 and one or more sidewalls 1320. This can result in a less noticeable transition from exterior layer 1310 and one or more sidewalls 1320.

In further embodiments one or more surfaces of enclosure 1300 can be roughened to further obscure the transition between exterior layer 1310 and the one or more sidewalls 1320 to make enclosure 1300 appear seamless. For example, in one embodiment exterior surface 1325 of exterior layer 1310 can be formed with a matte finish while exterior surface 1330 of one or more sidewalls 1320 can be formed with a smooth finish. The matte finish can be used to hide small imperfections in the cold weld interface and to make seam 1335 difficult to discern by touch and/or by sight.

Although electronic devices 100 and 200 (see FIGS. 1 and 2, respectively) are described and illustrated as two particular electronic devices, embodiments of the disclosure are suitable for use with a multiplicity of electronic devices. For example, any device that encloses an electrical assembly can be used with embodiments of the invention In some instances, embodiments of the disclosure are particularly well suited for use with portable electronic devices because of the importance of their aesthetic appearance. As used herein, an electronic media device includes any device with at least one electronic component. Such devices can include, for example, portable music players (e.g., MP3 devices and Apple's iPod devices), portable video players (e.g., portable DVD players), cellular telephones (e.g., smart telephones such as Apple's iPhone devices), wireless routers, video cameras, digital still cameras, projection systems (e.g., holographic projection systems), gaming systems, PDAs, as well as tablet (e.g., Apple's iPad devices), laptop or other mobile computers. Some of these devices can be configured to provide audio, video or other data or sensory output.

For simplicity, various internal components, such as the AC to DC power conversion circuitry, bus, memory, storage device and other components of electronic devices 100 and 200 (see FIGS. 1 and 2, respectively) are not shown in the figures.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Additionally, spatially relative terms, such as "bottom or "top" and the like can be used to describe an element and/or feature's relationship to another element(s) and/or feature(s)

as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at orientations) and the spatially relative descriptors used herein interpreted accordingly.

What is claimed is:

1. An enclosure for an electronic assembly, the enclosure having a seamless exterior appearance and comprising:

a housing having a rear wall and at least one side wall extending from the rear wall to a distal end;

a front wall including a front wall support and an exterior layer formed over the front wall support, wherein the front wall, the rear wall, and the at least one side wall define a cavity in which the electronic assembly is disposed;

at least two electrical prongs disposed through the rear wall and electrically coupled to, separate from and abutting the electronic assembly positioned within the cavity; and a receiving opening extending through the front wall and in communication with the cavity.

2. The enclosure of claim 1 wherein the front wall support is planar.

3. The enclosure of claim 1 wherein the front wall support has a convex shape.

4. The enclosure of claim 1 wherein the front wall support is formed from a metal and the exterior layer is formed from a plastic.

5. The enclosure of claim 1 wherein a ledge is formed in the at least one side wall.

6. The enclosure of claim 5 wherein the front wall support has a first side disposed against the ledge and a second side disposed against the exterior layer.

7. The enclosure of claim 1 wherein the electrical assembly has a connector aligned with the receiving opening.

8. The enclosure of claim 7 wherein the electronic assembly is an AC to DC adapter that receives AC power through the at least two electrical prongs and supplies DC power out of the connector.

9. The enclosure e of claim 1 further comprising a trim ring fit within the receiving opening.

10. The enclosure of claim 1 wherein an interface between the exterior layer of the front wall and the at least one side wall is curved.

11. A method of forming an enclosure having a seamless exterior appearance, the method comprising:

forming a housing having a rear wall opposite an opening and at least one sidewall extending between the rear wall and the opening forming a cavity, wherein the rear wall is formed around at least two electrical prongs extending through the rear wall;

placing an electronic assembly within the cavity such that it is electrically coupled to the at least two electrical prongs;

placing a front wall support having an aperture within the opening; and forming an exterior layer on an outside surface of the front wall support such that an exterior surface of the enclosure has a seamless appearance and has a receiving opening aligned with the aperture.

12. The method of claim 11 further comprising forming a ledge in a distal end of the at least on sidewall and placing the front wall support on the ledge.

13. The method of claim 11 wherein the exterior layer is formed with an injection molding process.

14. The method of claim 13 wherein the exterior layer bonds to the at least one sidewall at an interface.

15. The method of claim 11 wherein the front wall support is held in place during the forming of the exterior layer with tooling having a pair of fingers that extend through the aperture.

16. The method of claim 15 wherein the pair of fingers form a receiving opening in the exterior layer.

17. The method of claim 16 wherein the receiving opening is aligned with the aperture and a trim ring is placed within the receiving opening.

18. The method of claim 11 wherein injection mold tooling applies a force against the front wall support towards the rear wall such that plastic is prevented from flowing into the cavity during formation of the exterior layer.

19. The method of claim 11 wherein the housing has first sidewall opposite a second sidewall and a third sidewall opposite a fourth sidewall.

20. The method of claim 11 wherein the housing has one sidewall forming a cylinder.

* * * * *